US009347668B2

(12) United States Patent
Westmoreland et al.

(10) Patent No.: US 9,347,668 B2
(45) Date of Patent: May 24, 2016

(54) END COVER CONFIGURATION AND ASSEMBLY

(71) Applicant: General Electric Company, Schenectady, NY (US)

(72) Inventors: James Harold Westmoreland, Greer, SC (US); Patrick Benedict Melton, Horse Shoe, NC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 463 days.

(21) Appl. No.: 13/797,896

(22) Filed: Mar. 12, 2013

(65) Prior Publication Data

US 2014/0260276 A1 Sep. 18, 2014

(51) Int. Cl.
*F23R 3/12* (2006.01)
*F23R 3/28* (2006.01)

(52) U.S. Cl.
CPC ..... *F23R 3/286* (2013.01); *F23R 3/283* (2013.01); *F23R 2900/00019* (2013.01); *Y10T 29/494* (2015.01)

(58) Field of Classification Search
CPC ..... F23R 3/283; F23R 3/286; F23R 3/12; F23D 14/62
See application file for complete search history.

(56) References Cited

U.S. PATENT DOCUMENTS 1,855,165 A 4/1932 Barker
2,564,042 A 8/1951 Walker
3,581,492 A 6/1971 Norgren et al.
4,100,733 A * 7/1978 Striebel ..... F23R 3/286 239/419.3
4,408,461 A * 10/1983 Bruhwiler ..... F23R 3/32 60/737
4,763,481 A 8/1988 Cannon
5,121,597 A 6/1992 Urushidani et al.
5,235,814 A * 8/1993 Leonard ..... F23R 3/283 60/738
5,274,991 A 1/1994 Fitts
5,361,586 A 11/1994 McWhirter et al.
5,410,884 A 5/1995 Fukue et al.
5,415,000 A 5/1995 Mumford et al.
5,611,196 A 3/1997 Wilson
5,675,971 A 10/1997 Angel et al.
5,901,555 A 5/1999 Mandai et al.
5,927,076 A 7/1999 Pillsbury
5,943,866 A 8/1999 Lovett et al.
6,016,658 A 1/2000 Willis et al.
6,038,861 A * 3/2000 Amos ..... F23R 3/286 239/428
6,164,055 A * 12/2000 Lovett ..... F23R 3/32 431/114
6,351,948 B1 3/2002 Goeddeke
6,360,776 B1 3/2002 McCormick et al.
6,363,724 B1 * 4/2002 Bechtel ..... F23D 14/22 239/418
6,438,961 B2 8/2002 Tuthill et al.
6,530,222 B2 3/2003 Stuttaford et al.
6,532,742 B2 3/2003 Scarinci et al.

(Continued)

OTHER PUBLICATIONS

U.S. Appl. No. 13/797,848, filed Mar. 12, 2013, Boardman et al.

(Continued)

*Primary Examiner* — Thai Ba Trieu
*Assistant Examiner* — Shafiq Mian
(74) *Attorney, Agent, or Firm* — Fltecher Yoder, P.C.

(57) ABSTRACT

A system includes an end cover for a multi-tube fuel nozzle. The end cover includes a first side, a second side disposed opposite the first side, a plurality of fuel injectors disposed on the first side, and at least one pre-orifice disposed within a passage within the end cover between the first and second sides. The pre-orifice is configured to be removed through the end cover from the second side.

13 Claims, 6 Drawing Sheets

(56) References Cited

U.S. PATENT DOCUMENTS

| | | | | |
|---|---|---|---|---|
| 6,832,483 | B2 * | 12/2004 | Moriya | F23D 14/02 60/737 |
| 6,880,340 | B2 | 4/2005 | Saitoh | |
| 6,928,823 | B2 | 8/2005 | Inoue et al. | |
| 7,007,486 | B2 | 3/2006 | Sprouse et al. | |
| 7,134,287 | B2 | 11/2006 | Belsom et al. | |
| 7,171,813 | B2 | 2/2007 | Tanaka et al. | |
| 7,181,916 | B2 | 2/2007 | Ziminsky et al. | |
| 7,284,378 | B2 | 10/2007 | Amond, III et al. | |
| 7,469,544 | B2 | 12/2008 | Farhangi | |
| 7,578,130 | B1 | 8/2009 | Kraemer et al. | |
| 7,617,682 | B2 | 11/2009 | Bruck | |
| 7,841,180 | B2 | 11/2010 | Kraemer et al. | |
| 7,841,182 | B2 | 11/2010 | Martin | |
| 7,900,456 | B2 | 3/2011 | Mao | |
| 8,042,339 | B2 | 10/2011 | Lacy et al. | |
| 8,065,880 | B2 | 11/2011 | Ishizaka et al. | |
| 8,079,218 | B2 * | 12/2011 | Widener | F23D 14/48 60/737 |
| 8,104,291 | B2 | 1/2012 | Myers et al. | |
| 8,122,721 | B2 | 2/2012 | Johnson et al. | |
| 8,205,452 | B2 | 6/2012 | Boardman et al. | |
| 8,234,871 | B2 | 8/2012 | Davis, Jr. et al. | |
| 8,240,151 | B2 | 8/2012 | Pelletier et al. | |
| 8,266,912 | B2 | 9/2012 | Berry et al. | |
| 8,276,385 | B2 | 10/2012 | Zuo et al. | |
| 8,327,642 | B2 | 12/2012 | Uhm et al. | |
| 8,402,763 | B2 | 3/2013 | Mulherin et al. | |
| 8,408,004 | B2 | 4/2013 | Davis, Jr. et al. | |
| 8,424,311 | B2 | 4/2013 | York et al. | |
| 8,438,853 | B2 | 5/2013 | Green et al. | |
| 8,474,265 | B2 | 7/2013 | Jain et al. | |
| 8,484,978 | B2 | 7/2013 | Bailey et al. | |
| 8,505,304 | B2 | 8/2013 | Myers et al. | |
| 8,522,555 | B2 | 9/2013 | Berry et al. | |
| 8,528,334 | B2 | 9/2013 | Dutta et al. | |
| 8,528,336 | B2 | 9/2013 | Cihlar et al. | |
| 8,528,839 | B2 | 9/2013 | Bailey et al. | |
| 8,572,979 | B2 | 11/2013 | Smith et al. | |
| 8,616,002 | B2 | 12/2013 | Kraemer et al. | |
| 8,789,372 | B2 | 7/2014 | Johnson et al. | |
| 8,800,289 | B2 | 8/2014 | Johnson et al. | |
| 8,850,821 | B2 | 10/2014 | Khan et al. | |
| 8,899,049 | B2 | 12/2014 | Krull et al. | |
| 8,919,127 | B2 | 12/2014 | Melton et al. | |
| 8,938,978 | B2 | 1/2015 | Bailey et al. | |
| 8,966,909 | B2 | 3/2015 | Crothers et al. | |
| 9,032,704 | B2 | 5/2015 | Crothers et al. | |
| 9,151,502 | B2 | 10/2015 | Crothers et al. | |
| 9,163,839 | B2 | 10/2015 | Westmoreland et al. | |
| 9,200,571 | B2 | 12/2015 | Bailey et al. | |
| 9,255,711 | B2 | 2/2016 | Crothers et al. | |
| 2002/0128790 | A1 * | 9/2002 | Woodmansee | 702/81 |
| 2004/0163392 | A1 | 8/2004 | Nishida et al. | |
| 2009/0229269 | A1 * | 9/2009 | Lacy | F23R 3/28 60/737 |
| 2009/0241547 | A1 | 10/2009 | Luts et al. | |
| 2010/0089065 | A1 | 4/2010 | Tuthill | |
| 2010/0192579 | A1 * | 8/2010 | Boardman et al. | 60/737 |
| 2010/0192583 | A1 | 8/2010 | Cano Wolff et al. | |
| 2010/0205970 | A1 | 8/2010 | Hessler et al. | |
| 2010/0263384 | A1 | 10/2010 | Chila | |
| 2011/0016866 | A1 | 1/2011 | Boardman et al. | |
| 2011/0113783 | A1 | 5/2011 | Boardman et al. | |
| 2011/0209481 | A1 * | 9/2011 | Simmons | F23R 3/002 60/746 |
| 2012/0047902 | A1 | 3/2012 | Tuthill | |
| 2012/0180487 | A1 | 7/2012 | Uhm et al. | |
| 2012/0180488 | A1 * | 7/2012 | Bailey | F23K 5/14 60/739 |
| 2012/0227371 | A1 | 9/2012 | Johnson et al. | |
| 2013/0074503 | A1 | 3/2013 | Rohrssen et al. | |
| 2013/0125549 | A1 | 5/2013 | Bailey et al. | |
| 2013/0180256 | A1 | 7/2013 | Stoia | |
| 2013/0232977 | A1 | 9/2013 | Siddagangaiah et al. | |
| 2014/0260267 | A1 | 9/2014 | Melton et al. | |
| 2014/0260268 | A1 | 9/2014 | Westmoreland et al. | |
| 2014/0260299 | A1 | 9/2014 | Boardman et al. | |
| 2014/0283522 | A1 | 9/2014 | Boardman et al. | |
| 2014/0338338 | A1 | 11/2014 | Chila et al. | |

OTHER PUBLICATIONS

U.S. Appl. No. 13/797,859, filed Mar. 12, 2013, Boardman et al.
U.S. Appl. No. 13/797,883, filed Mar. 12, 2013, Melton et al.
U.S. Appl. No. 13/797,912, filed Mar. 12, 2013, Chila et al.
U.S. Appl. No. 13/797,925, filed Mar. 12, 2013, Westmoreland et al.
U.S. Appl. No. 13/797,961, filed Mar. 12, 2013, Westmoreland et al.
U.S. Appl. No. 13/797,986, filed Mar. 12, 2013, Chila et al.
U.S. Appl. No. 13/798,012, filed Mar. 12, 2013, Melton et al.
U.S. Appl. No. 13/798,027, filed Mar. 12, 2013, Westmoreland et al.
U.S. Appl. No. 13/400,248, filed Feb. 20, 2012, Westmoreland et al.
U.S. Appl. No. 13/705,443, filed Dec. 5, 2012, Belsom et al.

* cited by examiner

END COVER CONFIGURATION AND ASSEMBLY

BACKGROUND OF THE INVENTION

The subject matter disclosed herein relates generally to turbine combustors, and, more particularly, to an end cover for the turbine combustors.

A gas turbine engine combusts a mixture of fuel and air to generate hot combustion gases, which in turn drive one or more turbine stages. In particular, the hot combustion gases force turbine blades to rotate, thereby driving a shaft to rotate one or more loads, e.g., an electrical generator. The gas turbine engine includes a fuel nozzle assembly, e.g., with multiple fuel nozzles, to inject fuel and air into a combustor. The design and construction of the fuel nozzle assembly can significantly affect the mixing and combustion of fuel and air, which in turn can impact exhaust emissions (e.g., nitrogen oxides, carbon monoxide, etc.) and power output of the gas turbine engine. Furthermore, the design and construction of the fuel nozzle assembly can significantly affect the time, cost, and complexity of installation, removal, maintenance, and general servicing. Therefore, it would be desirable to improve the design and construction of the fuel nozzle assembly.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes an end cover for a multi-tube fuel nozzle. The end cover includes a first side, a second side disposed opposite the first side, a plurality of fuel injectors disposed on the first side, and at least one pre-orifice disposed within a passage within the end cover between the first and second sides. The pre-orifice is configured to be removed through the end cover from the second side.

In a second embodiment, a system includes an end cover of a combustor for a gas turbine. The end cover includes a first side, a second side disposed opposite the first side, and the first side is configured to reach a higher temperature relative to the second side during operation of the gas turbine. The end cover also includes a plurality of pre-orifice conduits disposed within respective passages within the end cover between the first and second sides, and the plurality of pre-orifice conduits is configured to be removed through the end cover from the second side.

In a third embodiment, a method for repairing an end cover for a multi-tube fuel nozzle includes removing at least one cover from the end cover to uncover a pre-orifice disposed within a passage between a first side and a second side of the end cover, wherein a plurality of fuel injectors are disposed on the first side. The method also includes removing the pre-orifice through the end cover from the second side.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to systems and a method for a fuel and air premixing system having a removable end cover, wherein the end cover includes a plurality of fuel injectors and at least one removable pre-orifice which may provide fuel to a fuel plenum. For example, in certain embodiments, the pre-orifice may be breech-loaded into the cold face of the end cover, and may be removed to enable inspection of the fuel plenum. The presently described system may provide lower manufacturing costs, easier repair procedures, longer equipment lifetime, and/or lower emissions, for example.

Figure 1:
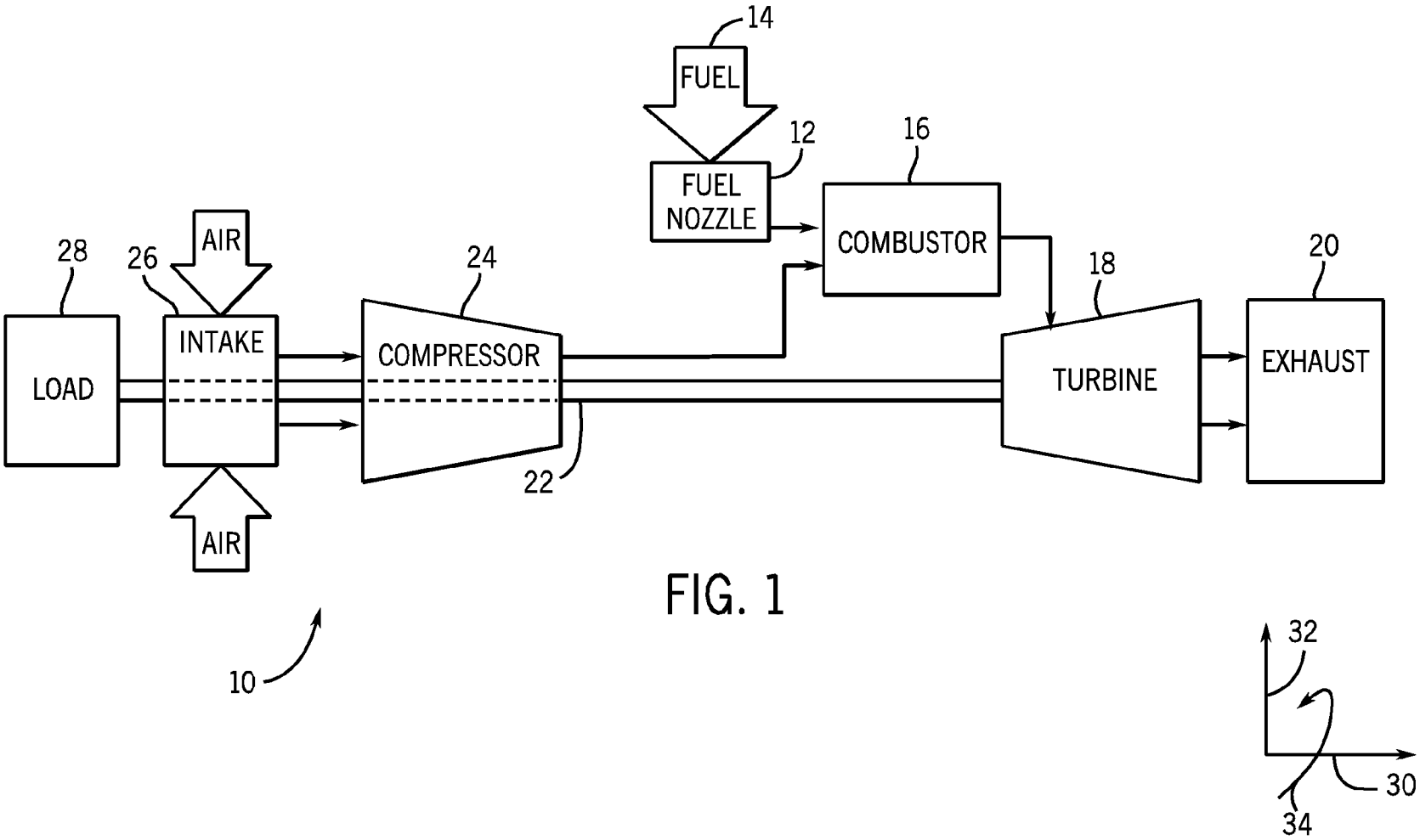
FIG. 1 is a block diagram of an embodiment of a turbine system having a multi-tube fuel nozzle.

FIG. 1 is a block diagram of an embodiment of a turbine system 10. As described in detail below, the disclosed turbine system 10 (e.g., a gas turbine engine) may employ an end cover with removable pre-orifice conduits, described below, which may improve system durability, operability, and reliability. The turbine system 10 may use liquid or gas fuel, such as natural gas and/or a hydrogen rich synthetic gas, to drive the turbine system 10. As depicted, fuel nozzles 12 (e.g., multi-tube fuel nozzles) intake a fuel supply 14, mix the fuel with air, and distribute the fuel-air mixture into a combustor 16 in a suitable ratio for optimal combustion, emissions, fuel consumption, and power output. The turbine system 10 may include one or more fuel nozzles 12 (e.g., multi-tube fuel nozzles) located inside one or more combustors 16. The fuel-air mixture combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 22 along an axis of the turbine system 10. As illustrated, the shaft 22 may be connected to various components of the turbine system 10, including a compressor 24. The compressor 24 also includes blades coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. The load 28 may include any suitable device capable of being powered by the rotational output of the turbine system 10. The turbine system 10 may extend along an axial direction or axis 30, a radial direction or axis 32 away from the axis 30, and a circumferential direction or axis 34 around the axis 30. The fuel nozzle 12 may contain an end cover having a removable pre-orifice conduit, described below, which may allow access to a fuel plenum for cleaning, inspection, and maintenance.

Figure 2:
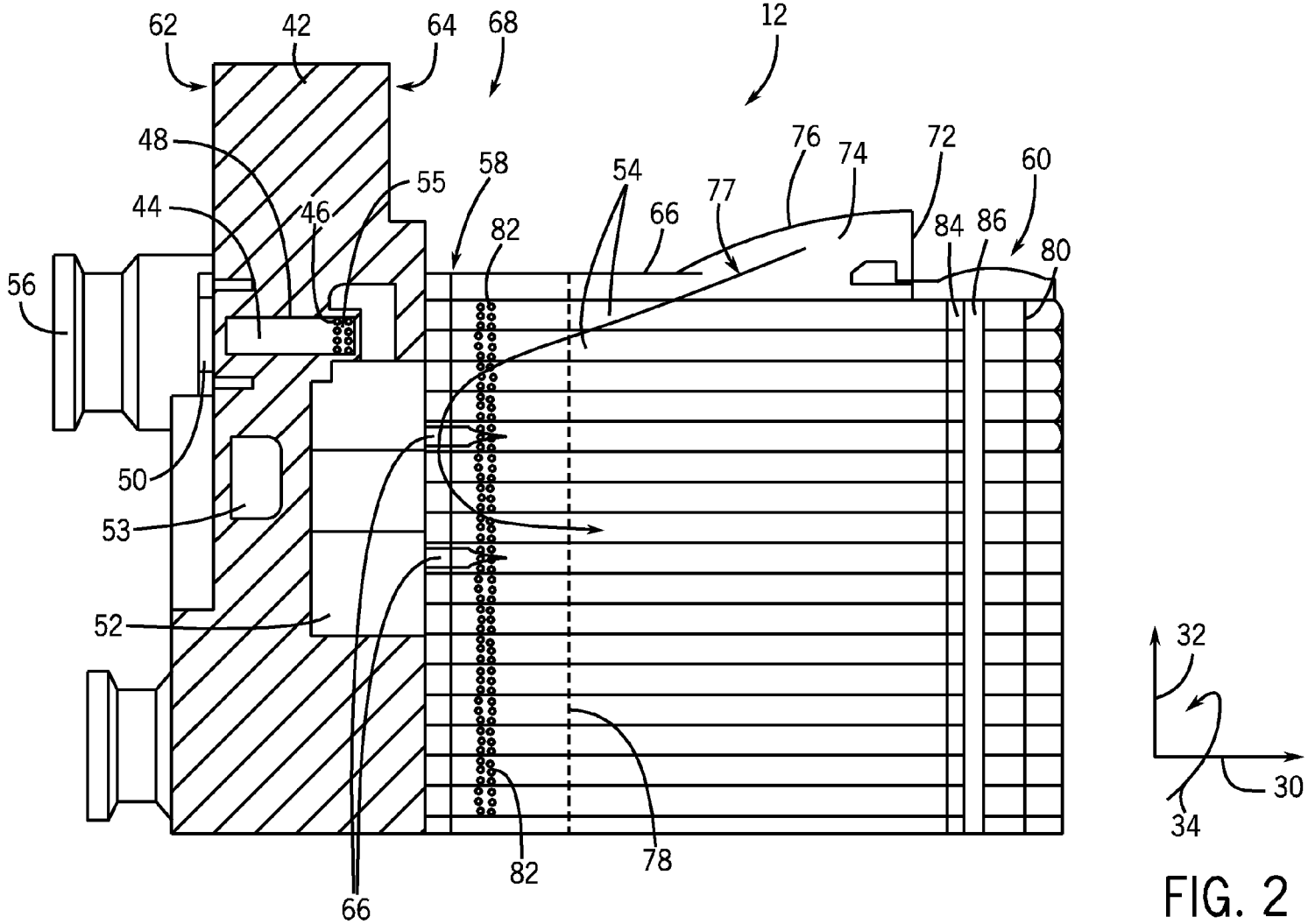
FIG. 2 is a cross-sectional side view of a portion of a combustor having the multi-tube fuel nozzle of FIG. 1 coupled to an end cover of the combustor.

FIG. 2 is a cross-sectional side view of a portion of the multi-tube fuel nozzle 12 coupled to the end cover 42. As shown, the end cover 42 may include a pre-orifice conduit 44 having apertures 46, a pre-orifice cavity 48, a pre-orifice cover 50, a fuel plenum 52, a fuel manifold 53, and a fuel inlet 56. Fuel 14 enters through the fuel inlet 56 and passes through the fuel manifold 53 to the pre-orifice conduit 44, which may fit inside the pre-orifice cavity 48 and may extend along the x-axis 30. A volume of fuel 14 flows through the pre-orifice conduit 44 toward the apertures 46 on a downstream end 55 of the pre-orifice conduit 44, which may extend into the fuel plenum 52. The fuel 14 may then flow through the apertures 46 into the fuel plenum 52. The apertures 46 in the pre-orifice conduit 44 may be of any of a variety of shapes and sizes, and may generally provide additional diffusion and distribution of the fuel 14, so as to improve distribution of the fuel 14 to the fuel plenum 52. From the fuel plenum 52, the fuel 14 may be distributed to a series of mixing tubes 54 and fuel injectors 66. A plurality of mixing tubes 54 may extend from an upstream side 56 to the downstream side 58 of the fuel nozzle 12. In some embodiments, the downstream side 58 of the mixing tube 54 may extend through a cap 80, so that a fuel-air mixture may be injected from the mixing tube 54 into the combustor 16, through an outlet generally located at the downstream side 58 of the mixing tube 54.

A portion of the downstream end 55 of each pre-orifice conduit 44 may extend into the fuel plenum 52, and each fuel plenum 52 may be fluidly connected to one or more fuel injectors 66. While only two fuel injectors 66 are shown in FIG. 2, it should be understood that each mixing tube 54 includes a respective fuel injector 66. In certain embodiments, the system 10 may include one, two, three, or more fuel plenums 52 that each provides fuel 14 to a subgroup of fuel injectors 66, and ultimately to the mixing tube 54 associated with each fuel injector 66. For example, one fuel plenum 44 may provide fuel to about 5, 10, 50, 70, 100, 500, 1000, or more fuel injectors 66. In some embodiments, the combustor 16 having subgroups of fuel injectors 66 supplied by different fuel plenums 52 may enable one or more subgroups of fuel injectors 66 and corresponding mixing tubes 54 to be run richer or leaner than others, which in turn may allow for more control of the combustion process, for example. Additionally, multiple fuel plenums 52 may enable the use of multiple types of fuel 14 (e.g., at the same time) with the combustor 16. The injectors 66 may be removably attached (e.g., threaded, brazed, etc.) to the fuel plenums 52, and extend inside corresponding mixing tubes 54. This arrangement may reduce thermal strains in the assembly, and the plenum design may allow for optimal fuel distribution to each mixing tube 54 and fuel injector 66. The fuel injectors 66 may be removable by machining or by unthreading.

The end cover 42 may have two sides, a cold face 62 and a hot face 64. The hot face 64 faces downstream (e.g., away from the pre-orifice conduit 44) and contains the fuel injectors 66. The cold face 62 faces upstream, away from the fuel injectors 66. In some embodiments, the end cover 42 may be positioned upstream of, and proximate to, the upstream side 56 of the mixing tubes 54. The end cover 42 may include one or more fuel inlets 56 through which the fuel 14 is provided to one or more fuel plenums 52. The end cover 42 may be removable, and may furthermore allow access to individual fuel plenums 52 and pre-orifice conduits 44. The pre-orifice conduit 44 may be breech-loaded, e.g., loaded from the upstream, cold face 62 of the end cover 42 into the pre-orifice cavity 48. The pre-orifice conduit 44 may be removably coupled (e.g., bolted, threaded, etc.) to the end cover 42, and may be removed from the cold face 62 of the end cover 42, thereby allowing access to the fuel plenums 52. Once the pre-orifice conduit 44 is removed, the apertures 46 may be visually inspected for debris and other end cover 42 passageways. Furthermore, removing the pre-orifice conduits 44 from the cold face 62 of the end cover 42 may enable inspection, cleaning, and/or maintenance of the fuel plenums 52 and the pre-orifice conduit 44. The pre-orifice conduit 44 may extend from along the x-axis 30 (e.g., pointing from upstream side 56 to downstream side 58) and may be breech-loaded (e.g., inserted into the cold face 62, of the end cover 42) into the pre-orifice cavity 48, and may then be covered on the cold face 62 by the pre-orifice cover 50, which may cover the pre-orifice cavity 48 within the end cover 42.

As shown in FIG. 2, a support structure 66 (e.g., wall) may surround a head end 68 of the fuel nozzle 12, and the support structure 66 may generally protect and/or support the mixing tubes 54 and other structures within the head end 68. In some embodiments, pressurized air 70 may enter the head end 68 through an air inlet 72. More specifically, pressurized air 70 may flow through the air inlet 72 into an air cavity 74 within the head end 68. The air cavity 74 consists of the volume of space within the head end 68 between the plurality of mixing tubes 54, and the pressurized air 70 spreads throughout the air cavity 74 as the pressurized air 70 flows to each of the plurality of mixing tubes 54. In some embodiments, a diffuser 76 may be provided in the combustor 16 to improve distribution of the pressurized air 70 within the head end 68. The diffuser 76 may be an annular flow conditioning diffuser configured to distribute the pressurized air 70 forward, radially inward, and/or externally across the plurality of mixing tubes 54 as shown by arrow 77. The pressurized air 70 may enter each mixing tube 54 through one or more apertures 82 in the mixing tubes 54, so that the pressurized air 70 may mix with the fuel 14, so that a fuel-air mixture may pass downstream inside the mixing tubes 54. In some embodiments, the diffuser 76 may diffuse the pressurized air 70 such that the pressurized air 70 is substantially evenly distributed to each mixing tube 54. Additionally or alternatively, a perforated air distribution plate 78, indicated by a dashed line in FIG. 2, may be provided within the fuel nozzle 12, and the air distribution plate 78 may generally be positioned between the end cover 42 and the cap 80. The perforations in the air distribution plate 78 may be of any of a variety of shapes and sizes, and may generally provide additional diffusion and distribution of the pressurized air 70, so as to improve distribution of the pressurized air 70 to the mixing tubes 54.

In some embodiments, the combustor 16 also has a retainer 84 and/or an impingement plate 86. The retainer 84 and/or the impingement plate 86 may be positioned downstream of the fuel injectors 66 and generally proximate to the cap 80. In some embodiments, the cap 80, the retainer 84, and/or the impingement plate 86 may be removable or separable from the support structure 66, for example. The retainer 84 and/or the impingement plate 86 may provide support for the mixing tubes 18. The impingement plate 86 may additionally or alternatively be configured to provide for cooling of the cap 80 within the combustor 16.

As discussed above and as shown in FIG. 2, one fuel injector 66 is provided for each mixing tube 54 of the combustor 16. In other words, one fuel injector 66 is positioned within a portion of each mixing tube 54 in order to deliver fuel 14 into the respective mixing tube 54. In some embodiments, the fuel injector 66 may be generally coaxially positioned within each mixing tube 54 by inserting the fuel injector 66 through an upstream end 60 of each mixing tube 54. Thus, the mixing tube 54 may have a size, shape, and configuration that enable each mixing tube 54 to receive the corresponding fuel injector 66.

In certain embodiments, a plurality of fuel injectors 66 may be coupled to the end cover 42 of the combustor 16. In some embodiments, the fuel injectors 66 may be removably coupled to the end cover 42. For example, the fuel injectors 66 may be brazed to the end cover 42 or the fuel injectors 66 may be threadably coupled to the end cover 42. Furthermore, the fuel injectors 66 may be threadably coupled and further sealed to the end cover 42. Generally, the fuel injectors 66 may be configured to be removed by machining or unthreading from the end cover 42. As discussed above, removing the pre-orifice conduit 42 from the cold side 62 of the end cover 42 may enable cleaning, inspection, and/or maintenance of the pre-orifice conduit 42 and the fuel plenum 52, and may therefore improve the durability, operability, and reliability of the end cover 42, as well as the fuel nozzle 12.

Figure 3:
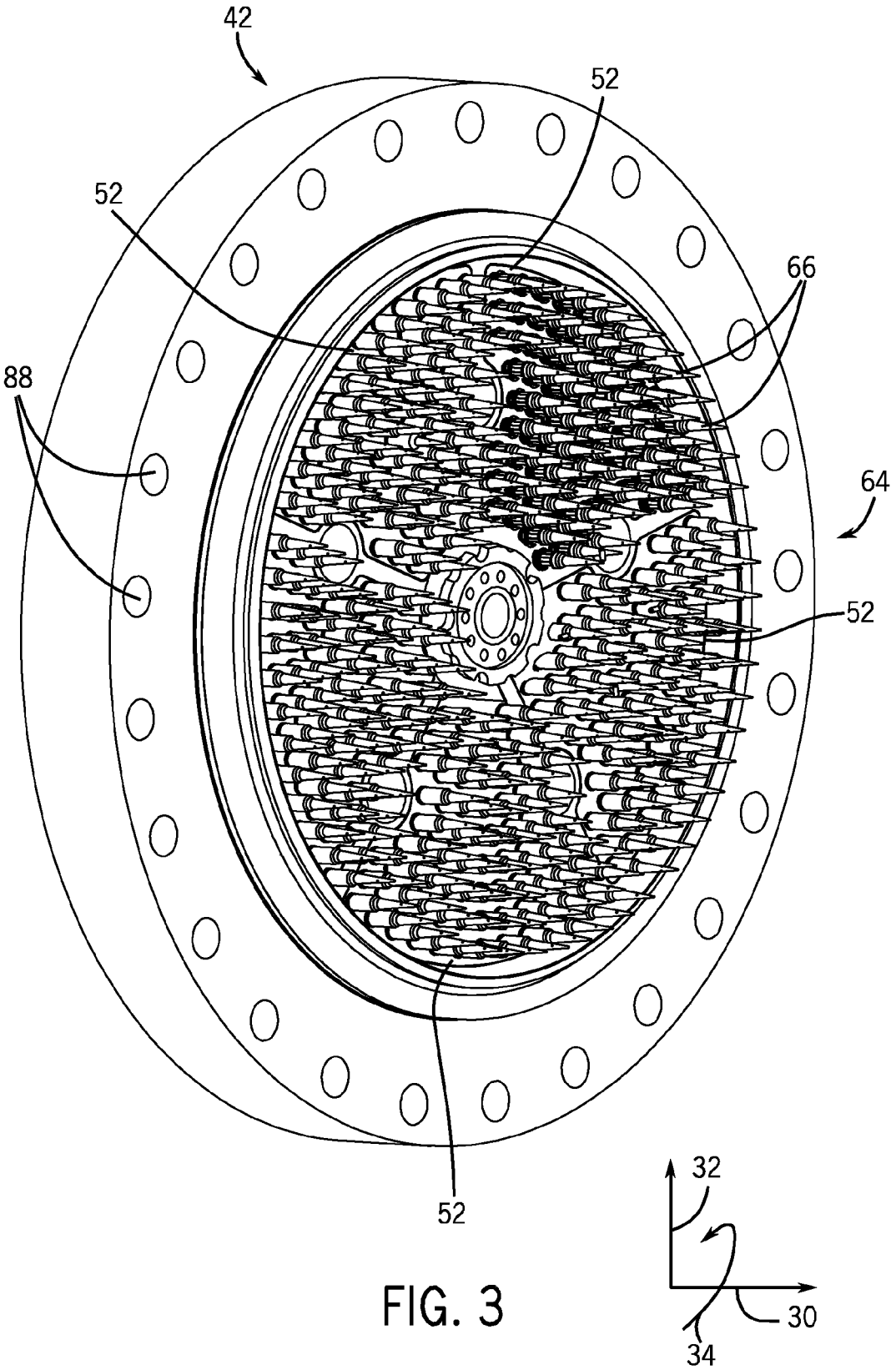
FIG. 3 is a perspective view of an embodiment of a removable end cover of a combustor having a removable pre-orifice.

FIG. 3 illustrates an embodiment of the hot face 64 of the end cover 42. The end cover 42 may include the plurality of pre-orifice conduits 44, the plurality of pre-orifice covers 50, and the plurality of fuel plenums 52, as shown in FIG. 2, as well as a plurality of the fuel injectors 66. Because the hot face 64 of the end cover 42, shown in FIG. 3, contains the fuel injectors 66 and faces downstream, in an axial direction 30, towards the combustor 16, it may be configured to reach a higher temperature relative to a second side 62 of the end cover 42 (e.g., the cold face 62) during operation of the turbine 18. With this in mind, the face 64 shown in FIG. 3 may be considered the hot face 64 of the end cover 42. In certain embodiments, the pre-orifice conduits 44 may be configured to be breech-loaded (e.g., inserted into a chamber integral to the rear portion, or cold face 62, of the end cover 72) into corresponding pre-orifice cavities 48 on the opposite face 62 of the end cover 42. As described above with reference to FIG. 2, the pre-orifice conduits 44 may have apertures 46, and may be configured to be removed from a face 62 (e.g., the cold face 62) opposite to the hot face 64 shown in FIG. 3. Each pre-orifice conduit 44 may have any number of apertures 46, which may be the same as or different than the number had by other pre-orifice conduits 44. For example, each pre-orifice conduit may have 1, 5, 10, 20, 50, or more apertures 46. Again, as shown in FIG. 2, the apertures 46 may extend circumferentially around the downstream end 55 of the pre-orifice conduit 44 in order to distribute the fuel 14 in a "shower-like" manner (e.g., disperse the fuel 14 outward into the fuel plenum 52). A portion of the downstream end 55 of at least one pre-orifice conduit 44 may extend into the fuel plenum 52, and may be further configured to provide fuel to the plenum 52. Each fuel plenum 52 may be in fluid communication with fuel injectors 66 (e.g., each fuel plenum 52 may supply a subgroup of fuel injectors 66, as described above). Specifically, FIG. 3 illustrates an embodiment having five fuel plenums 52, wherein each fuel plenum 52 is a wedge-shaped sector that extends circumferentially around the end cover 72, and each fuel plenum 52 supplies a subgroup of approximately 72 fuel injectors 66. The end cover 42 may enclose one or more removable, breech-loaded pre-orifice conduits 44 (e.g., the end cover 42 may contain about 5, 10, 50, 70, 100, or more pre-orifice conduits 44), which may be individually covered by the pre-orifice covers 50. The pre-orifice conduits 44 may be removed for inspection, repair, and/or replacement of individual pre-orifice conduits 44, and of fuel plenums 52. Furthermore, as noted above, in certain embodiments, the fuel injectors 66 may be individually removed and each of the fuel plenums 52 (and its associated subgroup of fuel injectors 66) may also be detached and removed from the end cover 42. In addition, the end cover 42 may be removably coupled to the fuel nozzle 12 (e.g., with fasteners such as bolts disposed in bolt receptacles 88), and may be removed as a whole. As a result, the end cover 42, having the removable pre-orifice conduits 44, may provide multiple options for removing, inspecting, repairing, and/or replacing the passageways of the end cover 42 (e.g., pre-orifice conduits 44 and fuel plenums 52) and associated apparatuses (e.g. fuel injectors 66).

The fuel injectors 66 may be arranged radially (e.g., one or more radial rows), circumferentially (e.g., one or more circumferential rows), or in any other suitable arrangement. The injectors 66 may be threaded, brazed, or otherwise removably coupled to the fuel plenums 52, and extend inside mating mixing tubes 54 as shown in FIG. 2. The mixing tubes 54 may enable the air 70 to mix with fuel 14 from the injectors 66, and transport the mixture to the combustor 16. This may be a lower cost, more modular, and more easily replaceable and inspectable sub-assembly, and a more reliable method to inject gaseous fuel into chamber 64, where micromixing can take place. The end cover 42 may minimize thermal stress and increase fuel distribution efficiency to each injector 66 and mixing tube 54. The same end cover 42 may be used for different volumes, fuels 14, or injectors 66. Furthermore, apertures 46 of the pre-orifice conduit 44 may be visually inspected for debris.

Figure 4:
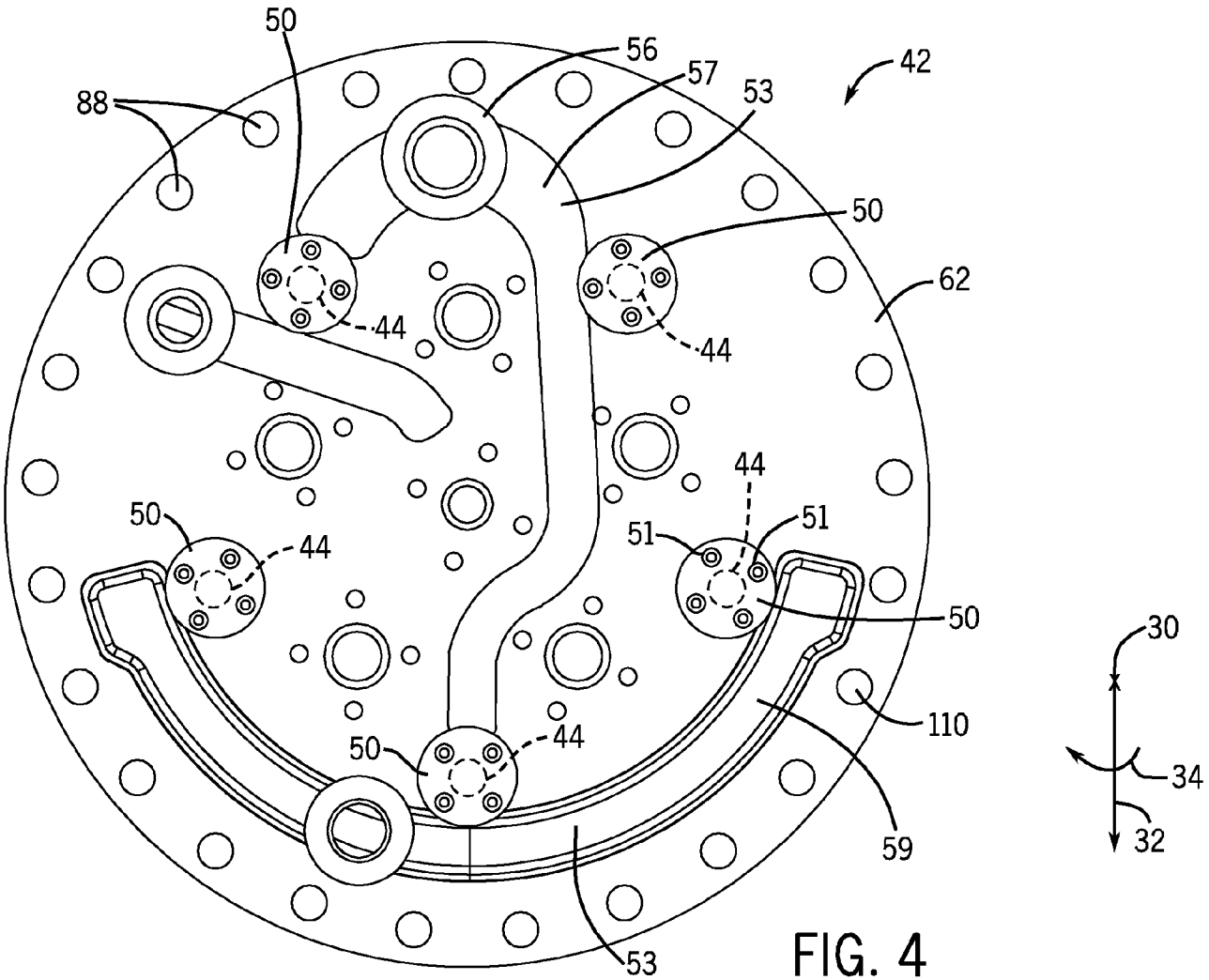
FIG. 4 is an embodiment of a view of a cold face of the end cover of FIG. 3.

FIG. 4 illustrates the cold face 62 of the end cover 42 shown in FIG. 3. Because this side 62 of the end cover 42 faces upstream, does not have fuel injectors 66, and does not face the combustor 16, this side 62 may be considered the cold face 62 of the end cover 42. The cold face 62 is not configured to get as hot as the hot face 64, which contains the fuel injectors 66. The cold face 62 may include the pre-orifice conduits 44, the pre-orifice covers 50, and the fuel manifolds 53. The pre-orifice covers 50 may have one or more openings 51 which fasteners, such as bolts, may extend through to attach each pre-orifice cover 50 to the end cover 42. As such, each pre-orifice cover 50 may be removed from the cold face 62. In the embodiment shown, the end cover 42 has five pre-orifice covers, which may correspond to an equal number of pre-orifice conduits 44 and fuel plenums 52. Under each pre-orifice cover 50 may be a pre-orifice conduit 44, which may provide fuel to one or more wedge-shaped fuel plenums 52. Each pre-orifice cover 50 may be breech-loaded into the end cover 42 (e.g., loaded from the cold face 62 of the end cover 42). The pre-orifice conduit 44 may be removed from the cold face 62, thereby allowing for cleaning, inspection, replacement, or maintenance of the fuel plenum 52. The end cover 42 may include several fuel manifolds 53, which may supply fuel to the pre-orifice conduits 44. For example, the end cover 42 shown in FIG. 4 includes a first fuel manifold 57 coupled to three pre-orifice conduits 44, and a second fuel manifold 59 coupled to two pre-orifice conduits 44. Multiple fuel manifolds 53 may enable multiple independent fuel circuits, allowing different fuels to be used simultaneously. As with the hot face 64 shown in FIG. 3, fasteners (e.g., bolts) may extend through receptacles 88 to attach the end cover 42 to the fuel plenums 52. Furthermore, fasteners (e.g., bolts) may extend through openings 51 to attach the pre-orifice covers 50 to the cold side 62 of the end cover 42. This removable coupling may allow the components of the end cover 42 to be more easily detached for inspection, maintenance, removal, and/or replacement. Having access to the fuel plenums 52 from the cold face 62 rather than the hot face 64 may increase the ease of maintaining the turbine system 10, thereby decreasing operational costs.

Figure 5:
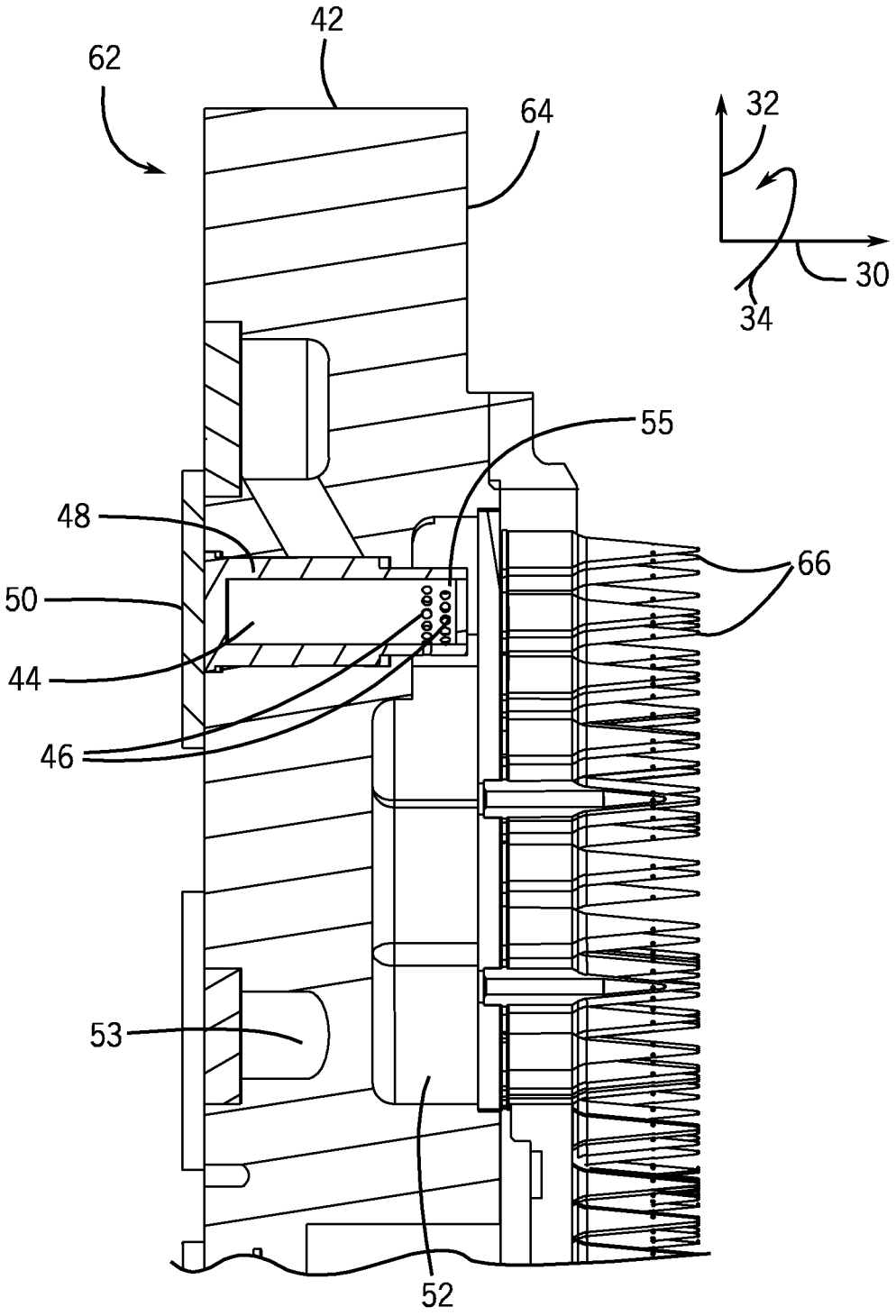
FIG. 5 is a cross-sectional side view of an embodiment of the end cover of FIG. 3.

FIG. 5 shows a side view of an embodiment of the end cover 42, having the cold face 62, the hot face 64, and the removable pre-orifice conduit 44. This embodiment may include the fuel manifold 53, the fuel plenum 52, and the fuel injectors 66. As discussed above, the fuel manifold 53 supplies fuel 14 to the pre-orifice conduit 44, which is loaded from the cold face 62 into the pre-orifice cavity 48. As shown, a portion of the downstream end of the pre-orifice conduit 44 may extend into the fuel plenum 52, and the fuel 14 may flow through the apertures 46 into the fuel plenum 52. From the fuel plenum 52, the fuel may be distributed to the various fuel injectors 66 attached to the fuel plenum 52. The pre-orifice cover 50 and the pre-orifice conduit 44 may be removed (e.g., unbolted, unthreaded, etc.) from the cold face 62 in order to enable inspection, cleaning, and/or removal of the fuel plenum 52 and the pre-orifice conduit 44. Individual covers 50 and conduits 44 may be removed from the end cover 42 to allow access to specific fuel plenums 52. The ability to inspect, clean, and/or remove individual fuel plenums 52 may extend the lifetime of the turbine system 10.

Figure 6:
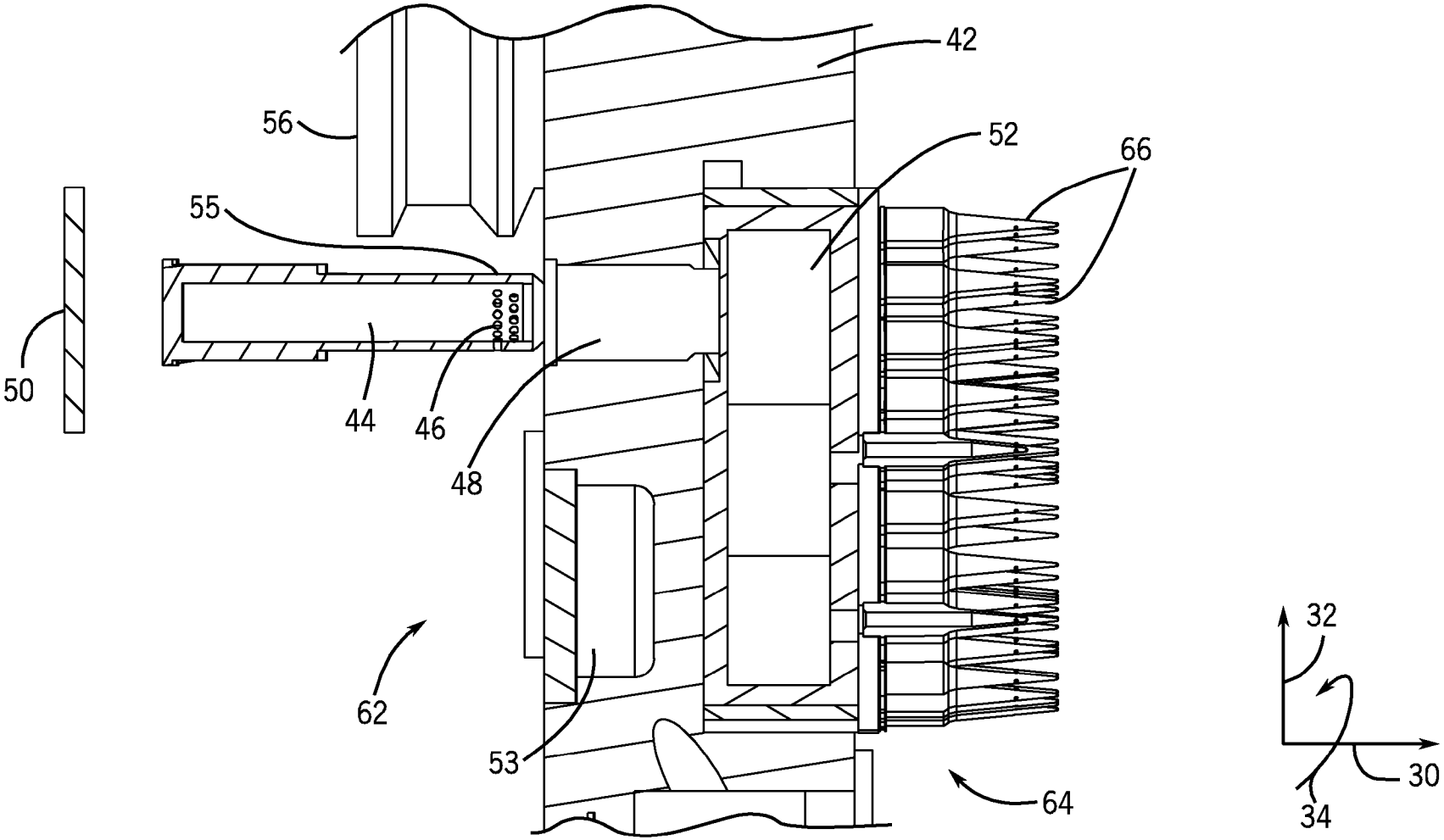
FIG. 6 is a cross-sectional exploded side view of the end cover of FIG. 3.

To better illustrate the components of the end cover 42 shown in FIG. 5, FIG. 6 depicts an exploded side view of the end cover 42 having the cold face 62, the hot face 64, and the removable pre-orifice conduit 44. Like FIG. 5, this embodiment may include the fuel manifold 53, the fuel plenum 52, and the fuel injectors 66. As described above, the pre-orifice conduit 44 may be loaded into the pre-orifice cavity 48 from the cold face 62 of the end cover 42. The pre-orifice cover 50 may shield and retain the pre-orifice conduit 44. A portion of the downstream end of the pre-orifice conduit 44 may extend into the fuel plenum 52, such that fuel 14 may flow from through the apertures 46, into the fuel plenum 52, which may feed the fuel to the fuel injectors 66. As noted above, the pre-orifice conduit 44 may be removably coupled (e.g., bolted, threaded, etc.) to the end cover 42 from the cold face 62, so that it may be removed in order to allow for inspection, cleaning, and/or maintenance of the fuel plenum 52. As described above, the ability to access the end cover 42 passages (e.g., the fuel plenums 52) through the pre-orifice conduits 44 from the cold face 62 may improve the quality of the repair cycle and may reduce the life cycle cost of the turbine system 10.

Technical effects of the disclosed embodiments include the combustor end cover 42, which includes a plurality of fuel injectors 66 and at least one removable pre-orifice conduit 44 which may provide fuel 14 to a fuel plenum 52. For example, in certain embodiments, the pre-orifice conduit 44 may be breech-loaded into the cold face 62 of the end cover 42, and may be removed to enable inspection of the fuel plenum 52. The presently described system may provide lower manufacturing costs, easier repair procedures, longer equipment lifetime, and/or lower emissions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system comprising:

an end cover of a multi-tube fuel nozzle, wherein the end cover comprises:

a first side;

a second side disposed opposite the first side;

a plurality of fuel injectors disposed on the first side;

a pre-orifice cavity extending through the end cover from the first side to the second side; and at least one pre-orifice conduit disposed within the pre-orifice cavity, wherein the at least one pre-orifice conduit comprises:

a longitudinal wall having a first end portion and a second end portion, the first end portion disposed to the second side within the end cover and the second end portion extends through and beyond the first side, a plurality of apertures disposed on the longitudinal wall of the at least one pre-orifice conduit on the second end portion to deliver fuel to a fuel plenum, and wherein the at least one pre-orifice conduit is configured to be removed through the end cover from the second side.

2. The system of claim 1, comprising a cover different from the end cover, the cover is disposed on the second side of the end cover over the pre-orifice cavity to enclose the at least one pre-orifice conduit within the end cover.

3. The system of claim 1, wherein the pre-orifice conduit is breech-loaded through the second side into the end cover.

4. The system of claim 1, wherein the end cover comprises the fuel plenum disposed within the end cover between the first and second sides, the second end portion of the at least one pre-orifice conduit is disposed within the fuel plenum, and the fuel plenum is in fluid communication with at least two or more fuel injectors of the plurality of fuel injectors.

5. The system of claim 1, wherein the system comprises a gas turbine engine, a combustor, the multi-tube fuel nozzle, or a combination thereof, having the end cover.

6. The system of claim 2, wherein the cover is configured to be removed to enable removal of the at least one pre orifice conduit through the end cover from the second side.

7. A system comprising:

an end cover of a combustor for a gas turbine engine, wherein the end cover comprises:

a first side;

a second side disposed opposite the first side, wherein the first side is configured to reach a higher temperature relative to the second side during operation of the gas turbine engine;

a plurality of pre-orifice cavities extending through the end cover from the first side to the second side; and a plurality of pre-orifice conduits disposed within respective said pre-orifice cavities within the end cover between the first and second sides, wherein each of the plurality of said pre-orifice conduits comprises:

a respective longitudinal wall, wherein each of the respective longitudinal wall having a respective first end portion and a respective second end portion, a plurality of apertures disposed on each of the respective second end portion to deliver fuel to a fuel plenum, and wherein the each of the plurality of said pre-orifice conduits is configured to be removed through the end cover from the second side; and a plurality of covers, wherein each cover is different from the end cover and is disposed on the second side of the end cover over one of the respective pre-orifice cavities to enclose a respective pre-orifice conduit of the each of the plurality of said pre-orifice conduits within the end cover.

8. The system of claim 7, wherein each of the cover is configured to be removed to enable removal of the respective pre-orifice conduit through the end cover from the second side.

9. The system of claim 7, wherein the end cover comprises a plurality of fuel injectors disposed on the first side.

10. The system of claim 7, wherein the each of the plurality of said pre-orifice conduits is breech-loaded through the second side into the end cover.

11. The system of claim 9, wherein the end cover comprises a plurality of fuel plenums disposed within the end cover between the first and second sides, and each of the fuel plenum of the plurality of fuel plenums is in fluid communication with at least one or more fuel injectors of the plurality of fuel injectors.

12. The system of claim 11, wherein a portion of a portion of the each of the plurality of said pre-orifice conduits extends into a respective fuel plenum of the plurality of fuel plenums.

13. The system of claim 12, wherein the each of the plurality of said pre-orifice conduits is configured to provide fuel to the respective fuel plenum of the plurality of fuel plenums via a plurality of apertures disposed on the longitudinal wall of the respective pre-orifice conduit.

* * * * *